United States Patent [19]

Scheinecker et al.

[11] 4,079,775

[45] Mar. 21, 1978

[54] METHOD AND AN ARRANGEMENT FOR INTRODUCING A STARTER BAR INTO THE STRAND GUIDING PATH OF A CONTINUOUS CASTING PLANT

[75] Inventors: Alois Scheinecker; Horst Wiesinger; Wilhelm Dutzler, all of Linz, Austria

[73] Assignee: Vereinigte Osterreichische Eisen- und Stahlwerke - Alpine Montan Aktiengesellschaft, Linz, Austria

[21] Appl. No.: 685,321

[22] Filed: May 11, 1976

[30] Foreign Application Priority Data

May 13, 1975 Austria ..... 3631/75

[51] Int. Cl.[2] ..... B22D 11/08

[52] U.S. Cl. ..... 164/82; 164/426

[58] Field of Search ..... 164/274, 282, 82

[56] References Cited

U.S. PATENT DOCUMENTS

| | | | |
|---|---|---|---|
| 3,338,297 | 8/1967 | Foldessy | 164/282 X |
| 3,672,438 | 6/1972 | Hofmann et al. | 164/282 |
| 3,762,462 | 10/1973 | Pietryka | 164/274 |
| 3,765,470 | 10/1973 | Huber | 164/274 |
| 3,817,316 | 6/1974 | Koch et al. | 164/274 |

*Primary Examiner*—Robert D. Baldwin

*Attorney, Agent, or Firm*—Brumbaugh, Graves, Donohue & Raymond

[57] ABSTRACT

A method of and arrangement for introducing a starter bar into the strand guide of a continuous casting plant has the starter bar introduced from above, foot part first, into the strand guide and lowered. An upper part of the strand guide is removable transverse to the strand axis so that an opening is formed in the strand guide. The starter bar is lowered after its foot part has been introduced, until the starter bar head has passed the opening, whereupon the removed strand part is returned into its initial position and the starter bar is moved upward until its head closes the mould.

15 Claims, 2 Drawing Figures

METHOD AND AN ARRANGEMENT FOR INTRODUCING A STARTER BAR INTO THE STRAND GUIDING PATH OF A CONTINUOUS CASTING PLANT

BACKGROUND OF THE INVENTION

The invention relates to a method and apparatus for getting a starter bar into the strand guide of a continuous casting plant, wherein the starter bar is introduced from above, foot part first, into the strand guide and lowered.

In continuous casting plants, substantial time losses can occur during the transition from one casting to the next one. These time losses above all are caused by the introduction of the starter bar for the following casting. In order to reduce these periods of standstill, various methods of introducing the starter bar have been developed, all aiming at introducing the starter bar, or a part thereof, into the strand guide from above at a time when the end portion of the strand of the previous casting is still being downwardly removed from the strand guide. Thus a method is known, in which the starter bar head is horizontally guided directly below the mould, introduced into the mould by jacks and held in that position by supports. When the hot strand has been removed, the starter bar body is introduced into the strand guide from below, advanced towards the mould and coupled with the starter bar head introduced from above. Before the next casting can start, the supports and jacks for the starter bar head have to be removed from the area of the cross section of the cast strand. Substantial operational means are required for carrying out this method, since the starter bar head which is separate from the starter bar body must be introduced into the strand guide by means of a separate transport means.

Furthermore, it is known to introduce the starter bar while connected to the starter bar head, via the continuous casting mould into the strand guide from above, foot part first. Thereby, on the one hand, it is possible to introduce the starter bar head together with the starter bar into the strand guide at a time when the end part of the strand of the previous casting is still being removed from the strand guide but, on the other hand, there is the danger that the mould may be damaged by the starter bar or the starter bar head. A further disadvantage consists in that the mould is not freely accessible for repair and maintenance work while the starter bar is being introduced. Also, it is not possible to exchange the mould while the starter bar is being introduced. It has, however, already been suggested to remove the mould from the axis of the strand, and to introduce the starter bar directly into the strand guide and lower it; but, this has the disadvantage that no adjustment and maintenance operations can be carried out on the mould while the starter bar is being introduced.

SUMMARY OF THE INVENTION

The invention aims at preventing the above described disadvantages and difficulties and has as its object to provide a method and an arrangement for carrying out that method, whereby periods of standstill in the transition from one casting to the next one are reduced and damage to the mould during the introduction of the starter bar into the strand guide is prevented. Furthermore, the mould is to be freely accessible for adjustment and maintenance operations while the starter bar is being introduced and a mould exchange — if necessary — is to be feasible.

In a method of the above described kind this object is achieved in that the upper part of the strand guide following the mould is removed in a direction transverse to the strand axis; in particular it is pivoted out so that an opening in the strand guide path is cleared. The starter bar is lowered, after its foot part has been introduced, until the starter bar head has passed the opening, whereupon the removed or pivoted out upper part of the strand guide is returned into its initial position and the starter bar is moved upward until the starter bar head closes the continuous casting mould.

The invention furthermore relates to an arrangement for carrying out this method with a continuous casting mould and a strand guide having supporting or bending and straightening rollers as well as transporting rollers, wherein a section of the strand guide below the mould and at a distance therefrom is removable from the strand guide path for providing an opening, and a transport means leading to this opening is provided for the starter bar. The arrangement is characterised in that the strand guide section following upon the mould is pivotable towards the inside or the outside of a curved roller guiding path around a horizontal axis. Also below or upon the casting platform a transport means, preferably designed as a car, is movable and has a roller path following the strand guide path when the car is in the introduction position.

Advantageously, the car, which is movable below the casting platform, has an arcuate run-in part in the introduction position bordering on the strand guide following the pivotable strand guide section.

According to a preferred embodiment of the invention, the strand guide section following the mould is pivotable around a horizontal axis provided at its lower end towards the inner side of the arc of the guiding path, and the car, which is movable on the casting platform, borders on the strand guide path of the pivoted-in strand guide section via a shaft provided on the casting platform.

Suitably, in a bow-type continuous casting plant, i.e. a plant with a curved guiding path, the pivotable strand guide section is the section containing the bending rollers of the strand guide.

BRIEF DESCRIPTION OF THE DRAWINGS

The invention shall now be described by way of two examples and with reference to the accompanying drawings, wherein.

DESCRIPTION OF A PREFERRED EMBODIMENT

Figure 1:
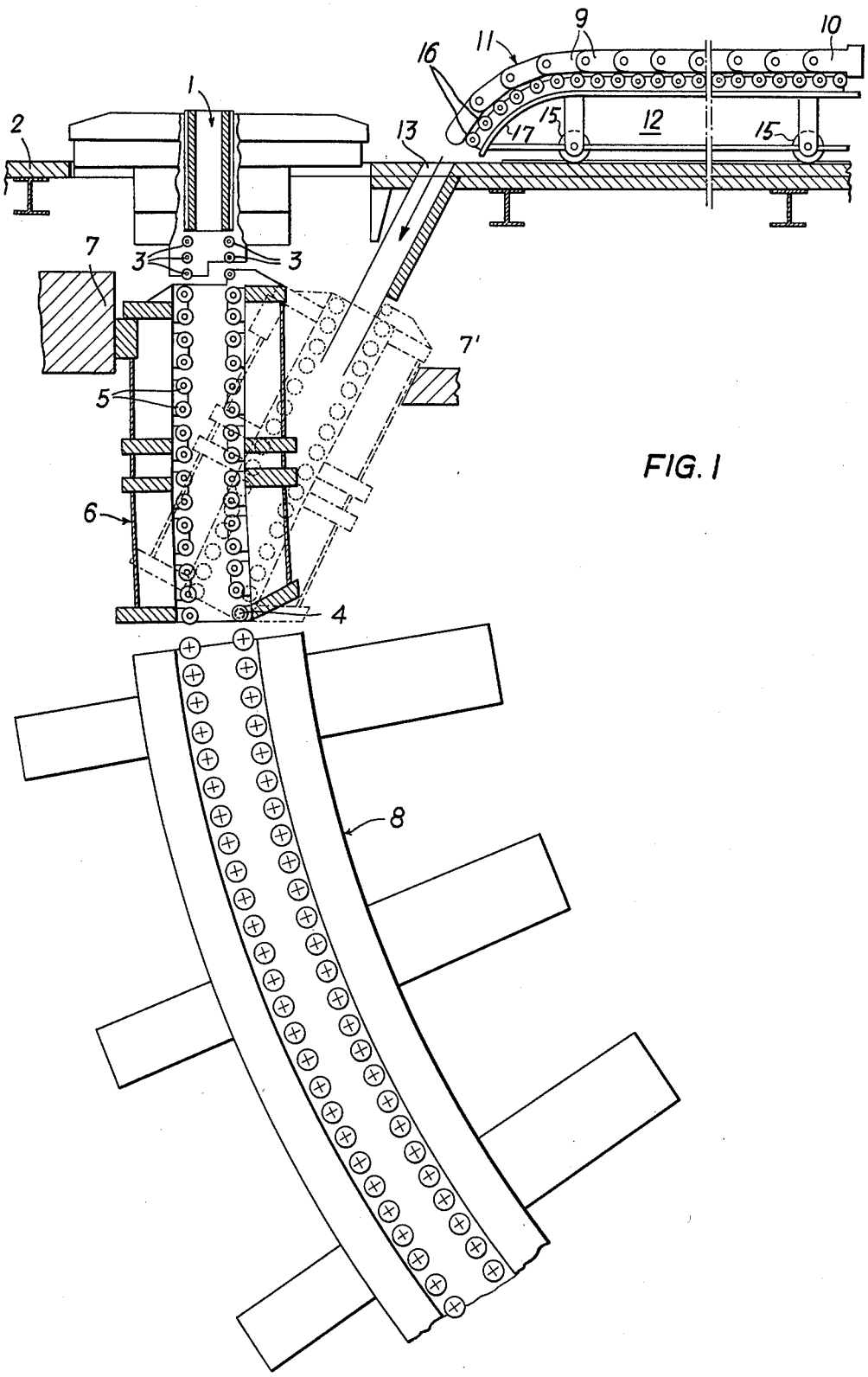
FIGS. 1 and 2 are each longitudinal sections through respective embodiments of schematically illustrated continuous casting plants.

A continuous casting mould 1 is arranged on a casting platform 2. In the extraction direction of the strand, rigid supporting rollers 3, which support and guide the strand, are arranged to follow the continuous casting mould. Behind the supporting rollers 3 in the extraction direction of the strand behind the supporting rollers 3 there follows an upper stand guide part 6 that is pivotable around an axis 4. which extends parallel to the axes of the rollers 3, which part carries supporting and bending rollers 5. For carrying out the pivoting there is provided an adjustment drive not illustrated in greater detail, such as, e.g., a pressure medium cylinder. The pivoting area of this stand part is limited by stops 7 and 7'. The remaining lower strand guide 8 is provided with supporting, driving and straightening rollers in a known manner. A starter bar 11, provided with members 9 articulately connected to one another and having a starter bar head 10 at one end thereof, is brought to the strand guide by a displaceable car 12, which travels on rollers 15.

According to FIG. 1, the pivotable stand part 6 may be pivoted around axis 4, coinciding with the roller axis, to such an extent that the longitudinal axis of the stand part 6 is aligned with the axis of a closable shaft 13 arranged in the casting platform 2. When the stand part 6 is in this position — entered in FIG. 1 in dot-and-dash lines — the starter bar can be introduced, via the run-in portion 17 of a roller track 16 on car 12, from above the casting platform into the strand guide in the direction of the arrow, foot part first, and lowered.

Figure 2:
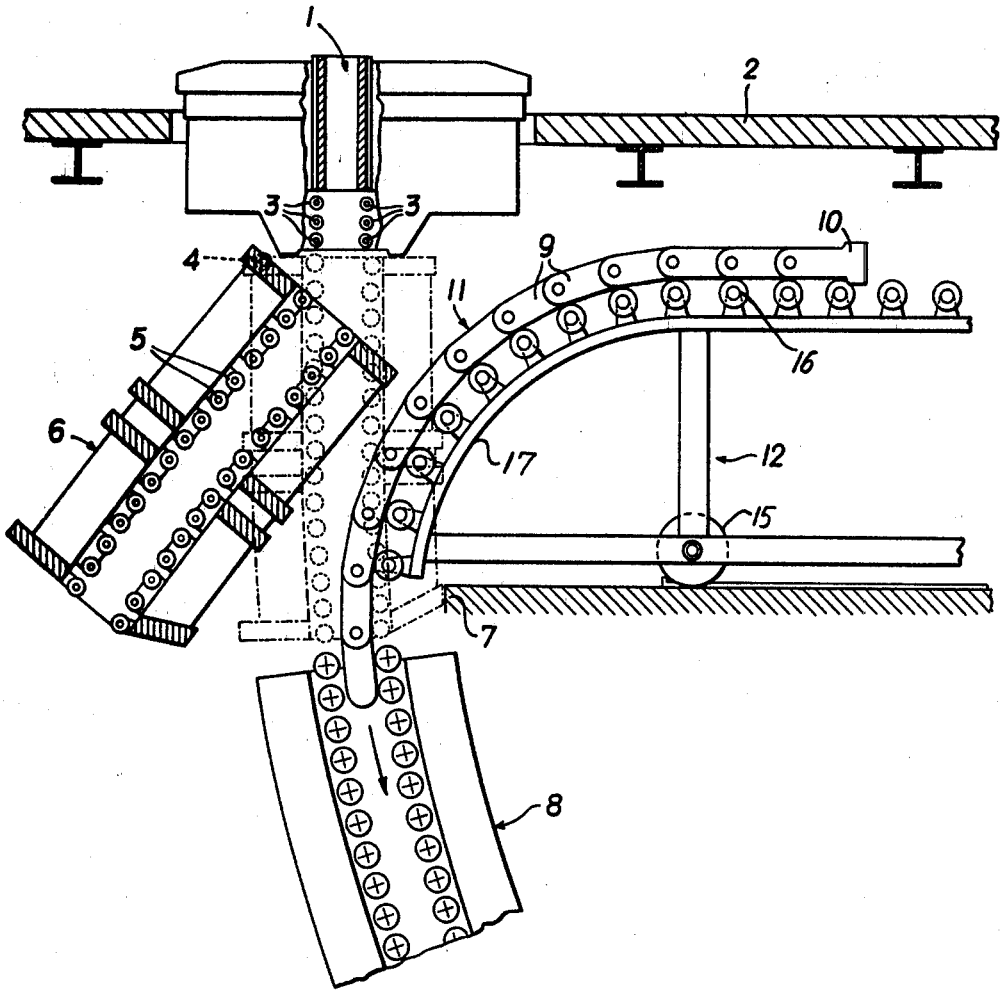

According to the second embodiment of the invention shown in FIG. 2, the stand part 6 is pivoted away from the car 12, whereby an opening is formed in the strand guide through which the starter bar can be introduced. In this case the car 12 for the starter bar 11 finds room below the casting platform 2 and as a result, it is possible to introduce the starter bar 11 into the strand guide from above the strand guide section 8 by means of a run-in section 17 of car 12, below the casting platform. This has the advantage that the casting platform 2 remains free for work to be carried out in the period between two castings which following each other.

It can be seen that according to both embodiments the mould and the lower part of the strand guide remain freely accessible for adjustment, maintenance and exchange operations, while the starter bar 11 is being introduced into the strand guide 8.

In both embodiments the starter bar is introduced into the strand guide to such an extent that the starter bar head is past the introduction opening thereof. Then the pivotable stand part 6 is pivoted back into its initial position and the starter bar is moved upward from below, by means of suitable transporting rollers arranged in the strand guide, until the starter bar head closes the exit opening of the continuous casting mould.

Various other embodiments of the arrangement of the invention are possible. Thus the pivoting of the stand part 6 can be carried out around any axis, including an axis extending at a right angle to one of the axes of rollers 5. It is also possible to form an opening for introducing the starter bar head by a parallel displacement of stand part 6 instead of its being pivoted.

An opening in the strand guide which is suitable for carrying out the method according to the invention also is created, if only the part of the stand part 6 carrying the rollers allocated to one side of the strand, and not the entire strand part, is pivoted or displaced parallelly, until the cross section of the strand guide is freely accessible.

I claim:

1. A method of introducing a starter bar, having a foot part and a starter bar head, into guide path structure having a plurality of sections defining a strand guiding path of a continuous casting plant having a continuous casting mould, comprising the steps of:

removing an upper section of said guide path structure, which section follows the continuous casting mould in a direction transverse to the axis of the strand guiding path so as to provide access to the space in which the strand travels in said guide path structure;

introducing said starter bar, foot part first, into said guide path structure via the access provided by removing said upper section;

lowering the starter bar until the starter bar head has passed into said guide path structure;

returning the removed upper section of said guide path structure; and moving said starter bar upwards until the starter bar head closes the continuous casting mould.

2. A method as set forth in claim 1, wherein the upper section of said guiding path is removed by pivoting.

3. In a continuous casting plant including a continuous casting mould arranged on a casting platform and a guide path structure with a plurality of rollers following the mould and defining a guiding path for a cast strand, an arrangement for introducing a starter bar, which has a foot part and a head, into said guide path structure, foot part first from above, which arrangement comprises:

an upper section of said guide path structure spaced from and following said continuous casting mould;

at least one lower section of said guide path structure following said upper section, said upper section being pivotable away from said guiding path about a horizontal axis so as to provide access to the space in which the strand travels in said guide path structure for the introduction of said starter bar; and a movable starter bar transporting means with a roller track, said transporting means mounted for movement to a position adjacent said guide path structure to allow for the introduction of said starter bar, foot part first, into said guide path structure via said roller track by means of the access provided by pivoting the upper section.

4. An arrangement as set forth in claim 3, wherein said guide path structure comprises supporting and transporting rollers.

5. An arrangement as set forth in claim 3 for a continuous casting plant having a curved guiding path, wherein said guide path structure supporting rollers, bending rollers, straightening rollers and transporting rollers.

6. An arrangement as set forth in claim 3 for a continuous casting plant having a curved guiding path, wherein said pivotable upper section of said guide path structure contains rollers for bending said cast strand.

7. An arrangement as set forth in claim 3, wherein said upper section of said guide path structure is inwardly pivotable about a horizontal axis.

8. An arrangement as set forth in claim 3, wherein said upper section of said guide path structure is outwardly pivotable about a horizontal axis.

9. An arrangement as set forth in claim 3, wherein the starter bar transporting means is movable on the casting platform.

10. An arrangement as set forth in claim 3, wherein the starter bar transporting means is movable below the casting platform.

11. An arrangement as set forth in claim 3, wherein the movable starter bar transporting means is a car.

12. In a continuous casting plant including a continuous casting mould arranged on a casting platform and a guide path structure with a plurality of rollers and following the mould and defining a guiding path for a cast strand, an arrangement for introducing a starter bar, which has a foot part and a head, into said guide path structure, foot part first from above, which arrangement comprises:

an upper section of said guide path structure spaced from and following said continuous casting mould, said upper section being pivotable away from said guiding path about a horizontal axis so as to provide an opening in said guide path structure for the introduction of said starter bar;

at least one lower section of said guide path structure following upon said upper section; and a starter bar transporting car with a roller track, said car mounted for movement below the casting platform and having an arcuate run-in portion for supporting at least part of the starter bar, said car being positionable relative to the guide path structure so that the end of the run-in portion is adjacent the top of the lower section of said guide path structure and the starter bar can be introduced, foot part first, into said lower section.

13. An arrangement as set forth in claim 12 wherein the continuous casting plant has a curved guiding path and the upper section of the guide path structure is pivoted toward the outside of the curve.

14. In a continuous casting plant including a continuous casting mould arranged on a casting platform and a guide path structure with a plurality of rollers following the mould and defining a guiding path for a cast strand, an arrangement for introducing a starter bar, which has a foot part and a head, into said guide path structure, foot part first from above, which arrangement comprises:

a shaft extending through the casting platform downwardly toward said guiding path at least part of the way to said guide path structure;

an upper section of said guide path structure spaced from and following said continuous casting mould, said upper section being pivotable away from said guiding path about a horizontal axis so as to align with the end of said shaft in order to permit the introduction of said starter bar into the guide path structure;

at least one lower section of said guide path structure following upon said upper section; and a starter bar transporting car with a roller track, said car mounted for movement on the casting platform and having an arcuate run-in portion for supporting at least part of the starter bar, said car being positionable so that its run-in portion is adjacent said shaft and the starter bar can be introduced, foot part first, into the top of said upper section via said shaft.

15. An arrangement as set forth in claim 14 wherein the continuous casting plant has a curved guiding path and said upper section of the guide path structure is pivoted toward the inside of the curve about a horizontal axis on the lower end thereof.

* * * * *

UNITED STATES PATENT OFFICE

CERTIFICATE OF CORRECTION

Patent No. 4,079,775 Dated March 21, 1978

Inventor(s) Scheinecker et al.

It is certified that error appears in the above-identified patent and that said Letters Patent are hereby corrected as shown below:

Col. 3, line 27, before "below" insert --but--;

Col. 3, line 32, "lower" should read --initial--; and

Col. 4, line 43, after "structure" insert --comprises--.

Signed and Sealed this

*Eighteenth* Day of *July 1978*

[SEAL]

*Attest:*

RUTH C. MASON
*Attesting Officer*

DONALD W. BANNER
*Commissioner of Patents and Trademarks*